United States Patent [19]

Donnelly et al.

[11] 3,944,783

[45] Mar. 16, 1976

[54] HIGH EFFICIENCY NON-CAVITY RADIANT METHOD AND APPARATUS

[75] Inventors: Thomas L. Donnelly; Edward J. Mullen, both of Webster, N.Y.

[73] Assignee: Xerox Corporation, Stamford, Conn.

[22] Filed: Oct. 18, 1974

[21] Appl. No.: 516,059

[52] U.S. Cl. ..... 219/216; 219/388; 432/8; 432/59; 432/230

[51] Int. Cl.[2] ..... H05B 1/00; G03G 15/00

[58] Field of Search ..... 219/216, 388; 432/59, 227, 432/8, 230, 1; 355/9, 17; 250/317–319

[56] References Cited

UNITED STATES PATENTS

| | | | |
|---|---|---|---|
| 3,436,523 | 4/1969 | Umahashi et al. | 219/216 |
| 3,445,626 | 5/1969 | Michaels | 219/388 X |
| 3,464,680 | 9/1969 | Nakamara et al. | 219/216 X |
| 3,529,129 | 9/1970 | Rees | 219/216 |

*Primary Examiner*—C. L. Albritton

[57] ABSTRACT

Flash fusing method and apparatus for fusing toner images onto flexible support material in which the support material is transported in a cylindrical path encircling the flash fusing lamp. The support material is a web or alternatively is in the form of copy sheets tacked onto a transport belt either by electrostatic tacking or by a vacuum transport and then advanced in a circular path around the flash with the toner images facing the flash lamp and receiving a uniform radiation therefrom.

9 Claims, 5 Drawing Figures

HIGH EFFICIENCY NON-CAVITY RADIANT METHOD AND APPARATUS

The invention relates generally to flash fusing, and in particular to method and apparatus for fusing toner images onto flexible support materials. More specifically, this invention relates to a xerographic flask fusing apparatus and method for rapidly and efficiently producing uniform image fixing on a flat support material.

In the xerographic process, a plate, generally comprising a conductive backing upon which is placed a photoconductive insulating surface, is uniformly charged and the photoconductive surface then exposed to a light image of an original to be reproduced. The photoconductive surface is caused to become conductive under the influence of the light image so as to selectively dissipate the electrostatic charge found thereon to produce what is developed by means of a variety of pigmented resin materials specifically made for this purpose which are known in the xerographic art as "toners." The toner material is electrostatically attracted to the latent image areas on the plate in proportion to the charge concentration found thereon. Areas of high charge concentration become areas of high toner density while correspondingly low charge image areas become proportionally less dense. The developed image is transferred to a final support material, typically paper, and fixed thereto to form a permanent record or copy of the original.

Many forms of image fixing techniques are known in the prior art, the most prevalent of which are vapor fixing, heat fixing, pressure fixing or a combination thereof as described in U.S. Pat. No. 3,539,161. Each of these techniques, by itself or in combination suffer from deficiencies which make their use impractical or difficult for specific xerographic applications. In general, it has been difficult to construct an entirely satisfactory heat fuser having a short warm-up time, high efficiency, and ease of control. A further problem associated with heat fusers has been their tendency to burn or scorch the support material. Pressure fixing methods, whether hot or cold have created problems with image offsetting, resolution degradation and producing consistently a good class of fix. On the other hand, vapor fixing, which typically employs a toxic solvent has proven commercially unfeasible because of the health hazard involed. Equipment to sufficiently isolate the fuser from the surrounding ambient air must by its very nature be complex and costly.

With the advent of new materials and new xerographic processing techniques, it is now feasible to construct automatic xerographic reproducing apparatus capable of producing copy at an extremely rapid rate. Radiant flash fusing is one practical method of image fixing that will lend itself readily to use in a high speed automatic process as described in U.S. Pat. No. 3,529,129. The main advantage of the flash fuser over the other known methods is that the energy, which is propagated in the form of electromagnetic waves, is instantaneously available and requires no intervening medium for its propagation. As can be seen, such apparatus does not require long warm-up periods nor does the energy have to be transferred through a relatively slow conductive or convective heat transfer mechanism.

Although an extremely rapid transfer of energy between the source and the receiving body is afforded by the flash fusing process, a major problem with flash fusing as applied to the xerographic fixing art, has been designing, apparatus which can fully and efficiently utilize a preponderance of the radiant energy emitted by the source during the relatively short flash period. The toner image typically constitutes a relatively small percentage of the total area of the copy receiving the radiant energy. Because of the properties of most copy materials, as for example, paper, most of the energy incident thereon is wasted by being transmitted through the copy or by being reflected away from the fusing area. Another disadvantage associated with the prior art flash fusing apparatus has heretofore been the non-uniformity of image fixing produced. This phenomena is primarily due to the fact that it is difficult to produce highly uniform irradiance on a large receiving surface as for example a sheet of paper, from a relatively small source such as a flash lamp.

While considerable effort has been expended in providing schemes for enhancing the efficiency and uniformity of fix of electrographic flash fusing systems, most efforts have been directed toward the provision of specially contoured reflecting surfaces which are designed to at least partially surround the flashlamp and thereby conserve energy via multiple reflections as set forth in U.S. Pat. No. 3,529,129. In addition to being costly to fabricate, such reflecting surfaces tend to become contaminated by loose toner particles and thereby necessitate frequent cleaning operations.

It is therefore an object of this invention to improve flash fusing of xerographic toner images on support material.

Another object of the invention is to accomplish flash fusing of electrostatic images on support material with a single flash for a predetermined area.

Another object of the invention is to enable highly efficient fusing of toner images onto flexible support sheets.

Another object of the invention is to enable efficient fusing of toner images onto web material.

For a better understanding of the invention as well as other objects and further features thereof, reference is had to the following description of the invention to be read in conjunction with the drawings wherein.

Figure 1:
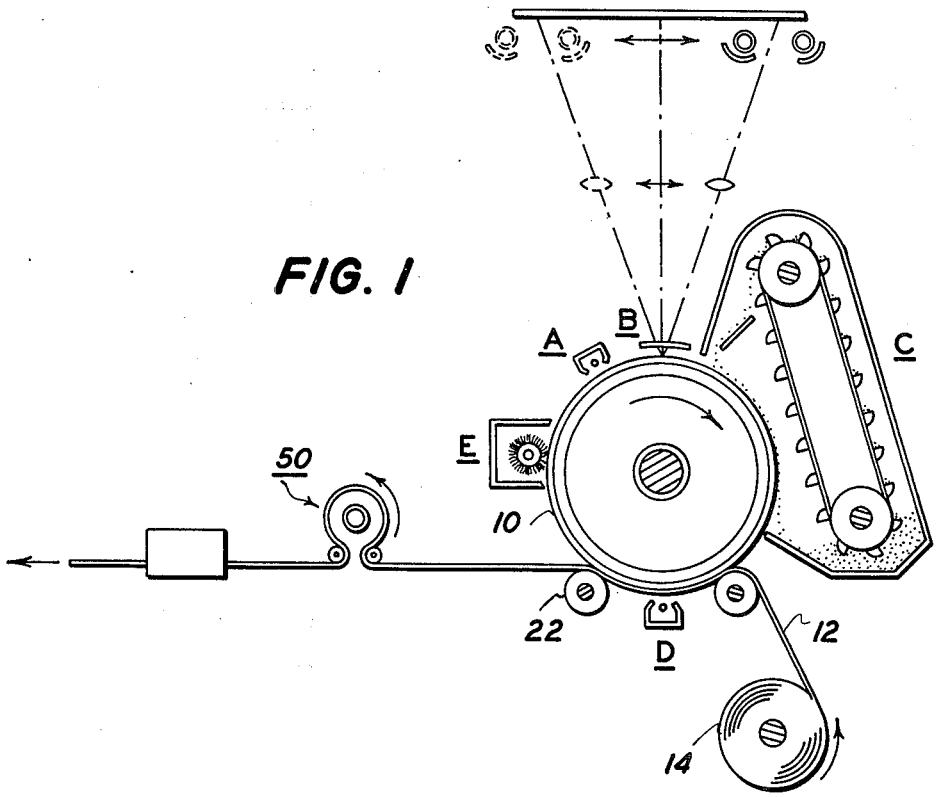
FIG. 1 is a schematic diagram illustrating xerographic apparatus incorporating fusing apparatus according to one embodiment of the invention.

Referring now to the drawings, there is shown schematically in FIG. 1 an embodiment of the subject invention in a suitable environment such as a xerographic or electrophotographic reproducing machine adapted for continuous and automatic operation. The machine includes an electrophotographic plate or surface 10 formed in the shape of a drum. The plate has a photoconductive or light responsive layer on a conductive backing, journaled in a frame to rotate in the direction indicated by the arrow. The rotation will cause the plate to sequentially pass a series of electrophotographic processing stations. For the purpose of the present disclosure, the several electrophotographic processing stations in the path of movement of the plate surface may be described functionally as follows:

A charging station A at which a uniform electrostatic charge is deposited on the photoconductive plate;

An exposure station B at which a light or radiation pattern of the copy to be reproduced is projected onto the plate surface to dissipate the charge in the exposed areas thereof to thereby form a latent electrostatic image of the copy to be reproduced;

A developing station C at which electrostatographic developing material, including toner particles having an electrostatic charge opposite that of the latent electrostatic image to form a visible toner image in configuration of the copy being reproduced;

A transfer station D at which the toner image is electrostatically transferred from the plate surface to a transfer material or a support surface, and;

A drum cleaning station E at which the plate surface is brushed to remove residual toner particles remaining thereon after image transfer and exposed to a relatively bright light source to effect substantially complete discharge of any residual electrostatic charge remaining thereon.

It is felt that the preceding description of the electrophotographic process is sufficient for an understanding of the instant invention. Further details of this type of electrophotographic apparatus may be had by reference to U.S. Pat. No. 3,301,126 issued to R. F. Osborne et al.

In addition to the apparatus disclosed in aforementioned Osborne et al patent, the electrophotographic machine is also provided with flash fusing apparatus 50 to permanently bond the toner image to the support material which forms the basis of the instant invention.

The support material, preferably paper, which is to form the final slpport for the toner images, as shown, is a web of material 12 wound about a support roll 14 at a supply station. The web is directed along a feed path to pass the transfer station D and guided by an idler roller 22 to the flash fusing apparatus 50. The web having the fused images thereon is guided from the fuser apparatus for ultimate withdrawal from the machine. The web may be subsequently cut into sheets as is known in the art.

Figure 2:
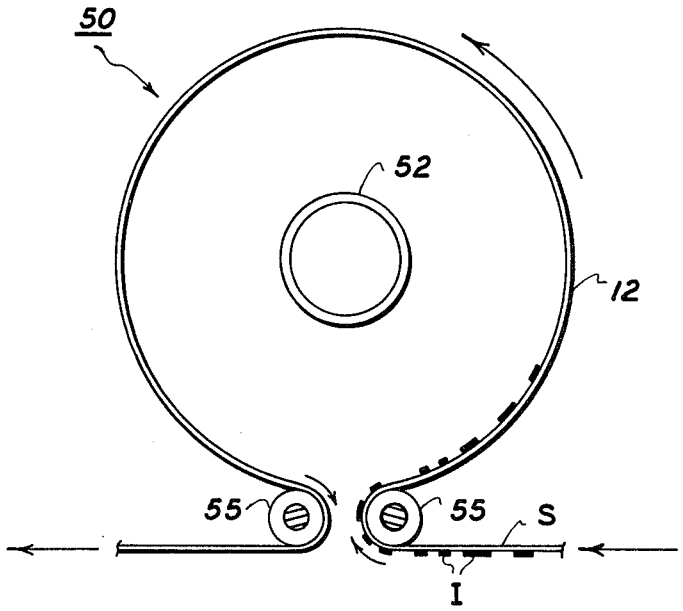
FIG. 2 is a detailed side view of the embodiment of the flash fusing apparatus of FIG. 1.

Referring now to FIG. 2, in accordance with the present invention loose image toner particles I, carried on support material 12, are fused thereto by cylindrically curling the material about the axis of an elongated source of radiant energy in the form of flash lamp 52. The web is advanced along the curved path by driven rollers 55 which are rotated in a direction indicated by the arrows. It will be appreciated that toner images I are moved along a circular path in the fusing zone such that the toner images are untouched and continuously face toward the center of curvature of the path where flash fusing lamp 52 is situated. It will be further appreciated that the flash fusing lamp fusing zone has a configuration which is circular or cylindrical such that uniform irradiance is insured to all points on the cylindrical surface from the particular flash lamp positioned along the central axis thereof. In this manner, it is not necessary to fuse the images onto a support material in piece meal fashion by energizing the lamp a number of times as different portions of the toner images are transported past the flash lamp.

Flash lamp 52 is energized at predetermined intervals by a suitable control circuit. After fusing of the images onto the web, the web can be cut into sheets and stacked by any suitable device.

It has been found that a Xenon flash lamp operating at power levels between 800 and 1200 Joules produces very good toner fusion. Pulse durations between 0.25 and 1.5 milliseconds were found to provide acceptable fusing with pulses between 0.5 and 1.2 milliseconds giving better fusing results. It has also been found that longer pulses of energy are required as the power level increases.

The efficiency of the fusing system of the above-described invention can reduce the power required to fuse ordinary copies by as much as 50 percent. It is believed that this is because of the unique configuration of the path through which the copy web is advanced past the flash fusing lamp.

Figure 3:
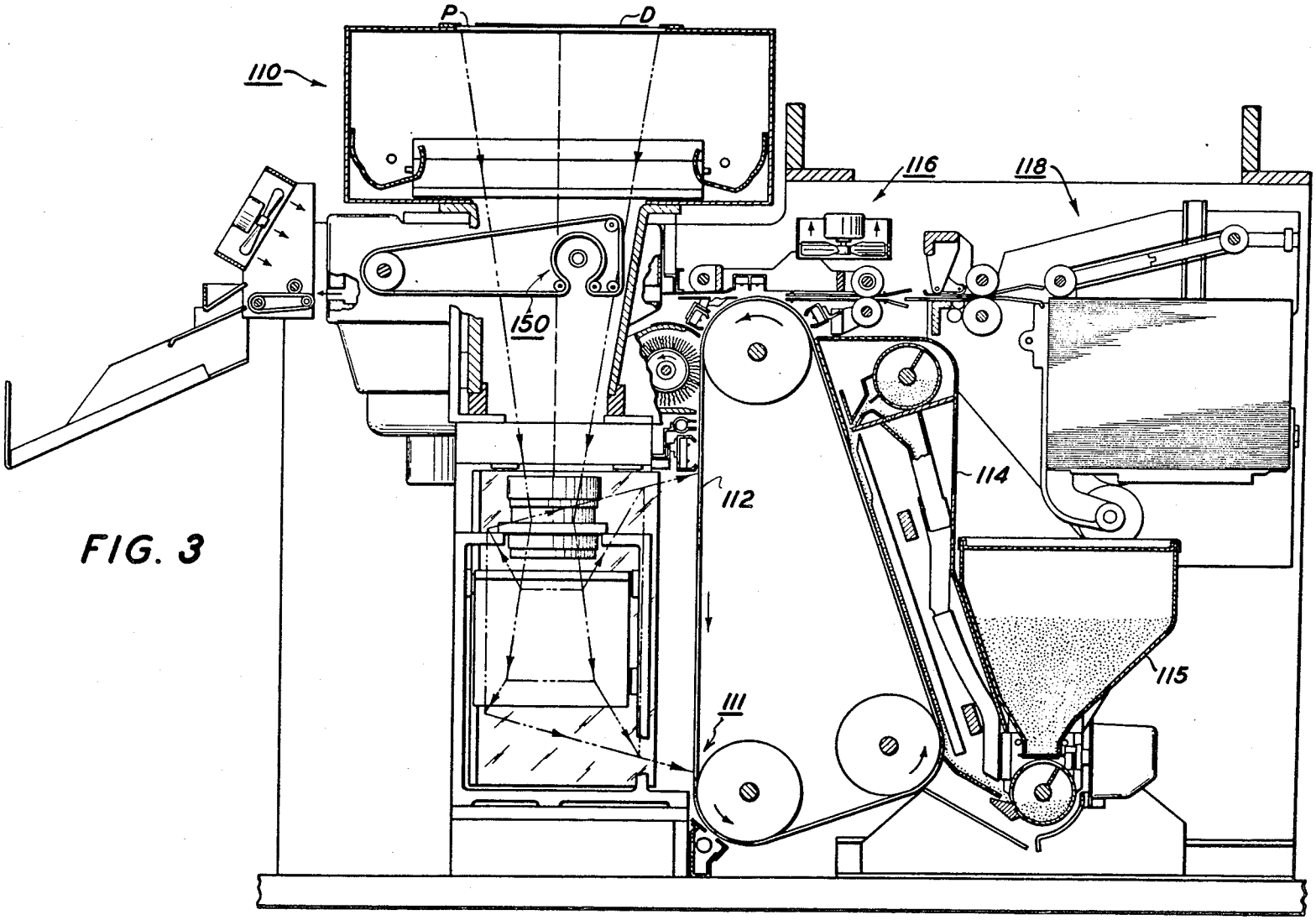
FIG. 3 is a schematic diagram illustrating xerographic apparatus incorporating a second embodiment of the fusing apparatus of the invention.

Referring now to FIG. 3, there is illustrated a schematic representation of an automatic xerographic reproducing machine employing another embodiment of the flash fusing apparatus of the present invention in which cut sheets are used. In the illustrated machine, an original D to be copied is placed upon a transparent support platen P fixedly arranged in an illumination assembly generally indicated by the reference numeral 110, arranged at the left end of the machine. The image rays are projected by means of an optical system for exposing the photosensitive surface of a xerographic plate in the form of a flexible photoconductive belt arranged on a belt assembly generally indicated by the reference numeral 111.

The photoconductive belt assembly 111 is slidably mounted upon the frame of the machine and is adapted to drive the belt 112 in the direction of the arrow at a constant rate. During this movement of the belt, the light image of the original on the platen is flashed upon the xerographic surface of the belt. The flash exposure of the belt surface to the light image discharges the photoconductive layer in the areas struck by light, whereby there remains on the belt a latent electrostatic image in image configuration corresponding to the light image projected from the original on the supporting platen. As the belt surface continues its movement, the electrostatic image passes through a developing station in which there is positioned a developer assembly generally indicated by the reference numeral 114. The developer assembly 114 deposits developing material to the upper part of the belt assembly 111 whereat the material is directed to cascade down over the upwardly moving inclined selenium belt 112 in order to provide development of the electrostatic image. As the developing material is cascaded over the xerographic plate, toner particles in the development material are deposited on the belt surface to form powder images.

The developer electrostatic image is transported by the belt to a transfer station whereat a sheet of copy paper is moved at a speed in synchronism with the moving belt in order to accomplish transfer of the developed image. There is provided at this station a sheet transport mechanism generally indicated at 116 adapted to transport sheets of paper from a paper handling mechanism generally indicated by the reference numeral 118 to the developed image on the belt at the station.

After the sheet is stripped from the belt 112, it is conveyed to a flash fuser apparatus generally indicated by the reference numeral 150 where the developed and transferred xerographic powder image on the sheet material is permanently affixed thereto according to the present invention as will be explained hereinafter. After fusing, the finished copy is discharged from the apparatus by a belt conveyor to a suitable point for collection externally of the apparatus.

Figure 4:
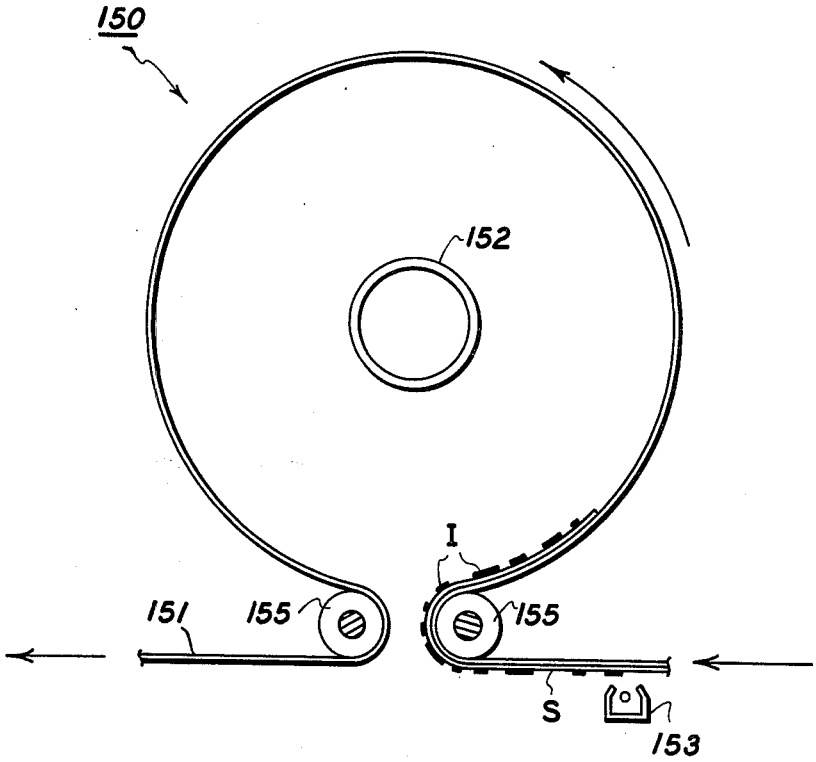
FIG. 4 is a detailed side view of the embodiment of FIG. 3.

Referring now to FIG. 4, loose image toner particles I, carried on flexible support sheet S, are fuxed thereto by cylindrically curling the support sheet S on a moving belt 151 transported about the axis of an elongated source of radiant energy in the form of a flash lamp 152. The support sheet S made of copy paper is electrostatically tacked to belt 151 which is made of any suitable insulating material such as mylar by a corona generating device 153 and transported along a circular path formed in the path of belt 151. Belt 151 is advanced by rotation of one of the rollers 155 which are rotated in a direction indicated by the arrows. It will be appreciated that sheet S of copy paper is moved along a circular path such that the toner bearing surface of the support sheet is untouched and continuously faces toward the center of curvature of the path where flash fusing lamp 152 is situated. It will be further appreciated that flash fusing apparatus 150 has a configuration in the fusing zone which is circular or cylindrical such that uniform irradiance is insured to all points on the cylindrical surface from the flash lamp positioned along the central axis thereof. In this manner it is not necessary to fuse the images onto a support sheet in piece meal fashion by energizing the lamp a number of times as different portions of the toner bearing sheet are transported past the flash lamp. Flash lamp 152 is energized by a sensing member 160 which is positioned to sense the leading edge of the sheet S before completing the circular path defined by web 151. Sheets S are removed from the web 151 by a suitable stripping device and advanced exterior to the machine.

Figure 5:
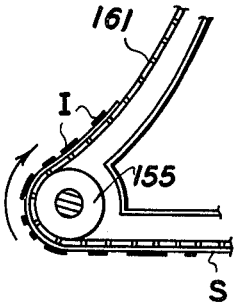
FIG. 5 is a view similar to FIG. 4 illustrating still another embodiment of the invention.

FIG. 5 shows another embodiment of the invention wherein belt 161 is perforated and a vacuum source applied so as to serve as a vacuum transport for sheets S.

While there have been shown and described and pointed out the fundamental novel features of the invention as applied to a preferred embodiment, it will be understood that various omissions and substitutions and changes in the form and details of the device illustrated and in its operation may be made by those skilled in the art without departing from the spirit of the invention.

What is claimed is:

1. Apparatus for fusing electroscopic toner particles to a flexible supporting surface, said apparatus comprising:

an elongated source of radiant energy; and a transport mechanism for transporting a flexible sheet bearing unfused toner particles along a predefined path, at least a portion of said path having a substantially cylindrical shape, said energy source being positioned in such a manner that the longitudinal axis thereof substantially coincides with the axis of said cylindrical shape, said transport mechanism comprising an endless web, means for advancing said web along said predefined path, and means for rendering said web attractive to said sheet whereby said sheet will cling to said web and be transported thereby.

2. The invention according to claim 1 wherein said source comprises a xenon flashlamp.

3. The invention according to claim 1 wherein said advancing means comprises a plurality of rollers.

4. The invention according to claim 1 wherein said web is composed of a dielectric material and said means for rendering said web attractive to said sheet comprises means for imparting an electrostatic charge to said web.

5. The invention according to claim 1 further comprising means for energing said flashlamp source when at least a portion of said sheet is positioned along said cylindrical path.

6. An improved flash fusing apparatus for fusing toner images on flexible support material comprising:

an elongated flash lamp, a cylindrically shaped belt member encircling said flash lamp along the longitudinal axis thereof, means for advancing said belt member along a predetermined path; and means for positioning a flexible support sheet bearing toner images along the moving belt member to form a circular path around said flash lamp whereupon energizing said lamp uniform radiation is imparted to the support sheet to fuse toner particles at a reduced power output.

7. Apparatus according to claim 6 wherein said belt member is made of an electrically insulating material on which the sheet is electrostatically attached.

8. Apparatus according to claim 6 wherein said belt is a transport under vacuum.

9. Apparatus according to claim 6 including sensing means for detecting the lead edge of the support sheet to provide a signal to energize the flash lamp.

* * * * *